US007204953B2

(12) United States Patent
Dratner et al.

(10) Patent No.: US 7,204,953 B2
(45) Date of Patent: Apr. 17, 2007

(54) COOLING PLATE

(75) Inventors: Christof Dratner, Osnabrück (DE); Franz Keiser, Belm (DE); Reinhard Hintemann, Osnabrück (DE); Frank Böert, Wallenhorst (DE); Hans-Günter Wobker, Bramsche (DE)

(73) Assignee: KM Europa Metal Aktiengesellschaft (DE)

( * ) Notice: Subject to any disclaimer, the term of this patent is extended or adjusted under 35 U.S.C. 154(b) by 0 days.

(21) Appl. No.: 11/112,762

(22) Filed: Apr. 21, 2005

(65) Prior Publication Data

US 2006/0017202 A1 Jan. 26, 2006

(30) Foreign Application Priority Data

Jul. 23, 2004 (DE) ..... 10 2004 035 963

(51) Int. Cl.
*C21B 7/10* (2006.01)

(52) U.S. Cl. ..... 266/193; 266/194

(58) Field of Classification Search ..... 266/193, 266/194

See application file for complete search history.

(56) References Cited

U.S. PATENT DOCUMENTS 4,157,816 A * 6/1979 Legille ..... 266/194
4,181,294 A * 1/1980 White, Jr. ..... 266/194
2005/0218569 A1* 10/2005 Stastny et al. ..... 266/193

FOREIGN PATENT DOCUMENTS

EP 0 951 371 10/1999
WO WO2004/018713 A1 * 3/2004

* cited by examiner

*Primary Examiner*—Scott Kastler
(74) *Attorney, Agent, or Firm*—Kenyon & Kenyon LLP

(57) ABSTRACT

A cooling plate (1) made of copper or a copper alloy for blast furnaces has a plurality of bore holes (6) for accommodating a cooling medium. The bore holes (6) are connected to a cooling medium intake (12) and a cooling medium outlet via connecting pipes (9) that are welded onto the cold side of the plate (5). Connecting pipes (9), at their plate ends (14), are furnished with flanges (15) that are formed by being flanged open. These flanges (15) are set into recesses (17) in the cold side of the plate (5), and are welded at their circumference by V seams (19) to the cold side of the plate (5).

19 Claims, 2 Drawing Sheets

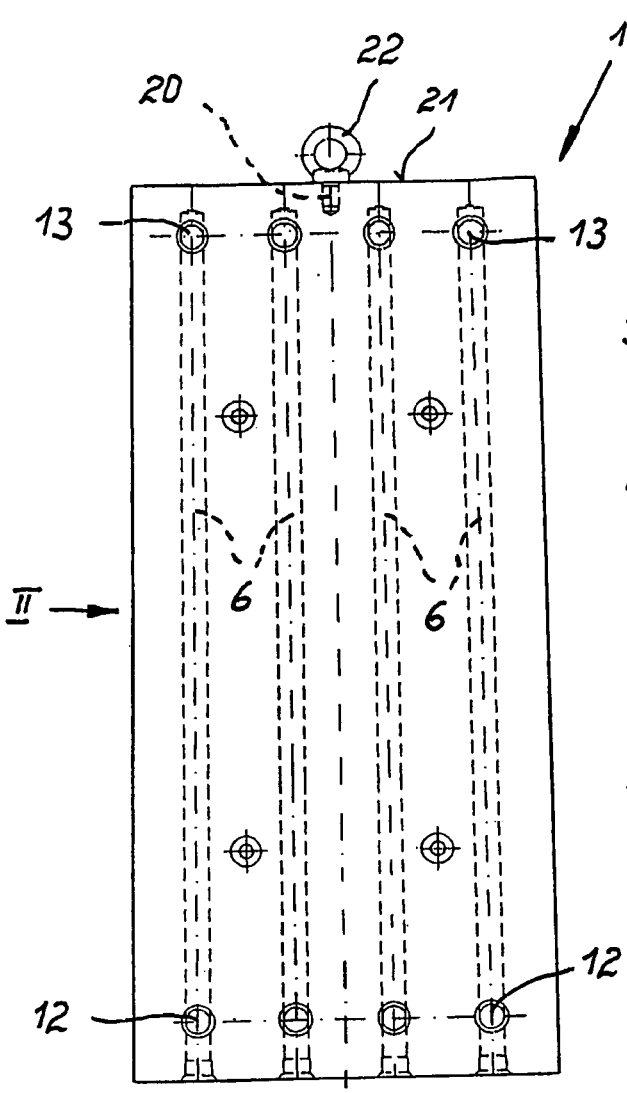
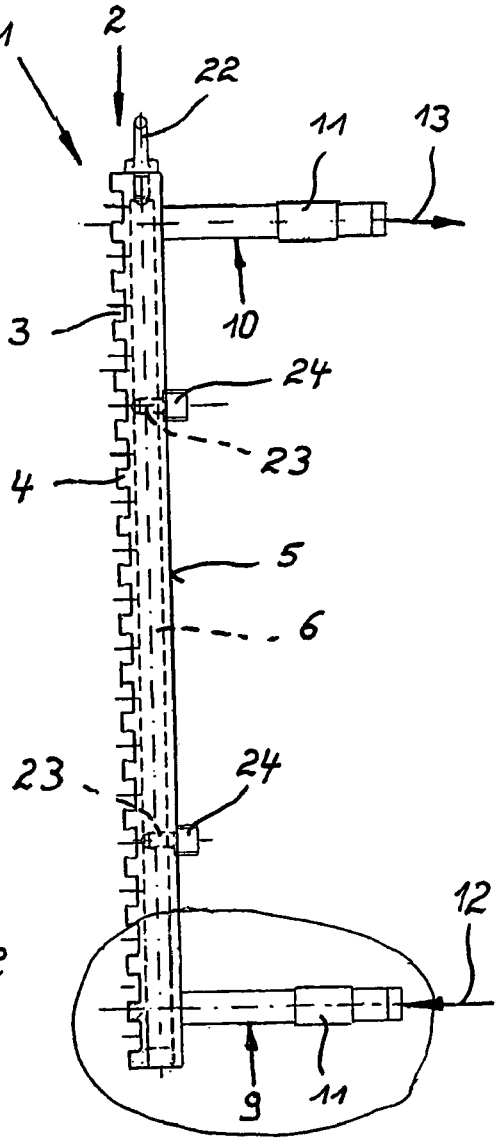
Fig. 1
Fig. 2
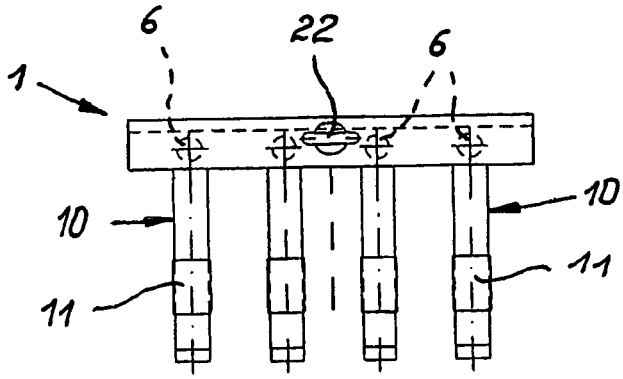
Fig. 3

COOLING PLATE

BACKGROUND OF THE INVENTION

1. Field of the Invention

The invention relates to a cooling plate made of copper or a copper alloy for blast furnaces.

2. Description of Related Art

A cooling plate known from the related art is disclosed in EP 0 951 371 B1. In the cooling plate several bore holes are provided, for accommodating a cooling medium, especially water, which are connected to a cooling medium intake and a cooling medium outlet via connecting pipes that are welded on at the cold side of the plate. The inner cross section of the connecting pipes is usually adapted to the diameter of the bore holes, Fixing the connecting pipes to the cooling plate, as a rule, is done in that, in the cold side of the plate recesses of small depth are produced that are adapted to the outer diameter of the connecting pipes, then the ends of the connecting pipes at the cooling plate are set into these recesses, and subsequently, the connecting pipes are welded to the cooling plate using fillet welds. In this connection, there is no special processing of the ends of the connecting pipes facing the plate. Usually they are mostly beveled on their inner side so as to ensure a better flow of the cooling medium.

If the connecting pipes are made of copper or a copper alloy, the connecting pipes connected to a steel cooling medium intake and cooling medium outlet are provided with a steel collar at a distance from the cooling plate. A steel collar is required in the case of connecting pipes made of copper or a copper alloy in order to produce a gas-tight weld to the blast furnace wall. Because of that, and also in response to the use of steel connecting pipes, one avoids that, when mounting the cooling plates in a blast furnace, copper has to be welded. Welding copper is technically very laborious and costly, and is connected with great risk of faults.

A further problem is, in a known case, that checking the fillet welds, such as by the use of color penetration testing, especially in the case of Cu welding seams, is technically possible, to be sure, but is involved with considerable expenditure.

Since the connecting pipes have to be welded to the cooling plate on the one side, and on the other side a gas-tight connection, especially by welding, has to be produced between the connecting pipes and the blast furnace wall, because of the thermal expansion of the cooling plate, during use, stresses come about at the welding seams between the cooling plate and the connecting pipes.

SUMMARY OF THE INVENTION

It is an object of the invention to create a cooling plate of copper or a copper alloy for blast furnaces, in which an increased fatigue strength of the connection between the cooling plate and the connecting pipes is achieved by a better accommodation and passing on of the stresses that occur in practical use.

These and other objects of the invention are achieved by a cooling plate made of copper or a copper alloy for blast furnaces, in which a plurality of bore holes (6) are provided for accommodating a cooling medium, which are connected to a cooling medium intake (12) and a cooling medium outlet (13) via connecting pipes (9, 10) that are welded onto cold side of the plate (5), wherein the connecting pipes (9, 10) are furnished with flanges (15) at their plate ends (14), have their flanges (15) set into the recesses (17) of the cold side of the plate (5), and are welded at the circumference of the flanges (15) to the cold side of the plate (5).

BRIEF DESCRIPTION OF THE DRAWINGS

The invention will be described in greater detail with reference to the following drawings wherein:

FIG. 1 shows a cooling plate for a blast furnace, as seen from the cold side of the plate.

FIG. 2 shows a side view of the cooling plate of FIG. 1 in the direction of arrow II of FIG. 1.

FIG. 3 shows a top view of the cooling plate of FIG. 1.

DETAILED DESCRIPTION OF THE INVENTION

Figure 4:
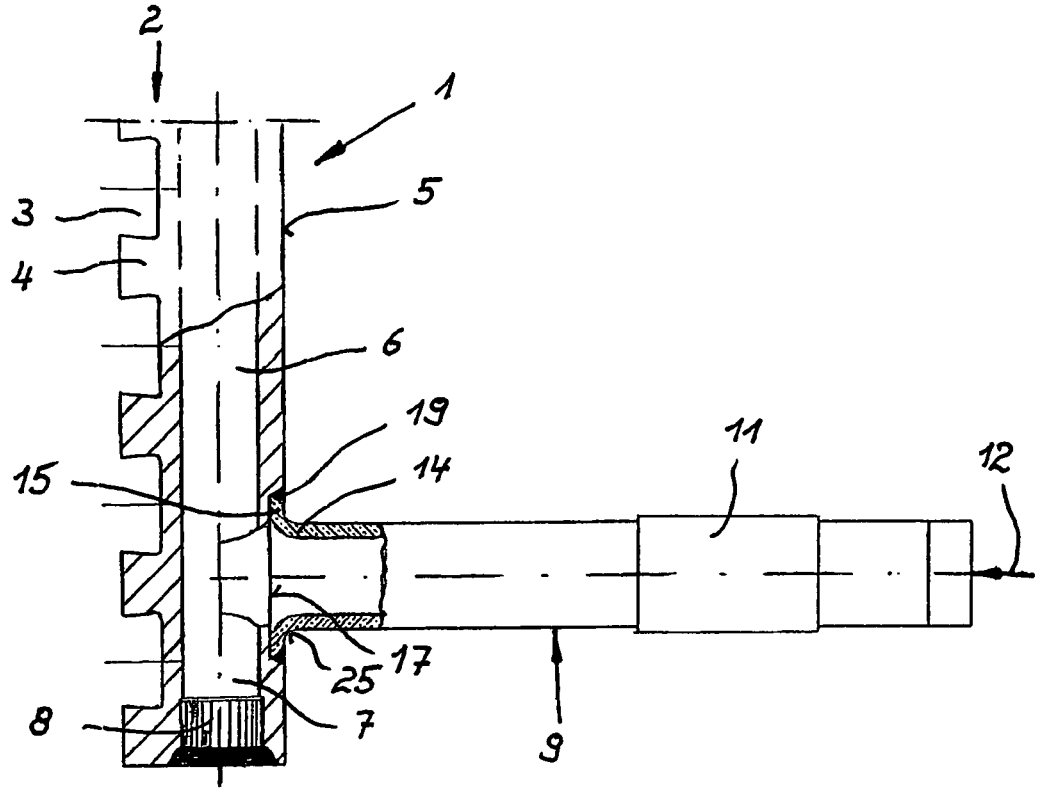
FIG. 4 shows on an enlarged scale, partially in section, the connecting region between the cooling plate and a connecting pipe according to cutout IV of FIG. 2.

At this point, the connecting pipes, depending on whether they are made of copper or a copper alloy, of steel or of a combination of these materials, are provided, at their ends facing the plate, with radially projecting flanges. These flanges are fitted into recesses of slight depth provided on the cold side of the plate, and then welded to the cold side of the plate at their circumference. Because of this, the welding seam is no longer located in the region in which the maxima of the stress occur. Conventional welding methods may be used, such as friction stir welding, electron beam welding or even laser welding.

In order to be able to deliberately weld a V seam between a flange and the cold side of the plate, which is clearly simpler than welding a fillet weld, it is provided that the flange is provided at its outer circumference, and the recesses in the cold side of the plate at their inner circumference, with bevels. In this manner, an almost ideal welding seam preparation is created, and, using the V seam, an increased fatigue strength of the connection is ensured.

Although it is absolutely conceivable that the flanges are formed by diameter reduction of pipes, by contrast, an advantageous attaining of the object is seen in that the flanges are formed by flanging out the ends of the connecting pipes at the plate end. Such a flanging out may be undertaken without a problem, both on connecting pipes made of copper or copper alloys or of steel. Comparatively thin-walled connecting pipes may be used.

If the connecting pipes are blasted in the concave transition regions towards the flanges, for instance by shot peening, the strength values of the connecting pipes in the area of the flanges may be increased still further. It is possible that each bore hole in the cooling plate may be connected via connecting pipes to the cooling medium intake and the cooling medium outlet.

With a view to the facts of the case, that practice often requires the connection of oval bore holes in a cooling plate to connecting pipes or even the coupling of two or more smaller diameter bore holes in the cooling plate to connecting pipes, which demands as great as possible an overlapping of the connecting pipes with the bore holes, the present invention provides that at least two adjacent bore holes are connected in each case by one connecting pipe to the cooling medium intake and the cooling medium outlet.

In this connection, it may then be advantageous that the plate end of the connecting pipes is shaped to be oval. This specific embodiment has its advantage if the bore holes in the cooling plate are developed oval (independent of their production) or if at least two bore holes of small diameter are to be coupled to one connecting pipe.

It is especially expedient that connecting pipes made of copper or a copper alloy are provided with steel collars at a distance from the flanges. By the use of steel collars it is avoided that, on site, during the mounting of a cooling plate, copper has to be welded.

If the connecting pipes are made of steel or a steel alloy, it is of advantage that the bevels at the connecting pipes and/or the bevels in the recesses are coated with nickel.

In another specific embodiment, the connecting pipes are provided with flanges that are welded on. The flanges and the connecting pipes may be made of the same materials. But it is also imaginable that the flanges and the connecting pipes are formed of different materials. Thus, for example, it is conceivable that the flanges are made of a copper alloy and the connecting pipes are made of a steel alloy.

If the flanges are also made of a steel alloy and provided with bevels, it is expedient that the bevels at the flanges and/or the bevels in the recesses in the cold side of the plate are coated with nickel.

In FIGS. 1 through 5, a cooling plate made of a copper alloy for blast furnaces is designated as 1. On the hot side of the plate 2, cooling plate 1 has alternatingly grooves 3 and projections 4. On the cold side of the plate 5, cooling plate 1 is designed to be flat.

In cooling plate 1, several bore holes 6 are provided as deep hole bores, which are used to accommodate a cooling medium, such as especially water. These bore holes 6, designed as blind holes, have plugs 8 at intake ends 7.

Bore holes 6 may be connected to connecting pipes 9, 10 individually or group-wise (at correspondingly reduced diameter). In FIGS. 1 through 5, each bore hole is connected to a connecting pipe 9, 10 that conduct cooling media. But it is also thinkable that, in the region of connecting pipes 9, 10, bore holes 6 of smaller diameters are gathered group-wise (two to four bore holes 6), and these bore holes 6 are then connected via direct connections or via inclined bore holes to connecting pipes 9, 10.

In the exemplary embodiment, connecting pipes 9, 10, coupled to cooling medium intakes 12 and cooling medium outlets 13 are made of a copper alloy. They are provided with circumferential collars 11 made of steel, which are welded gas-tight to a blast furnace wall.

Figure 5:
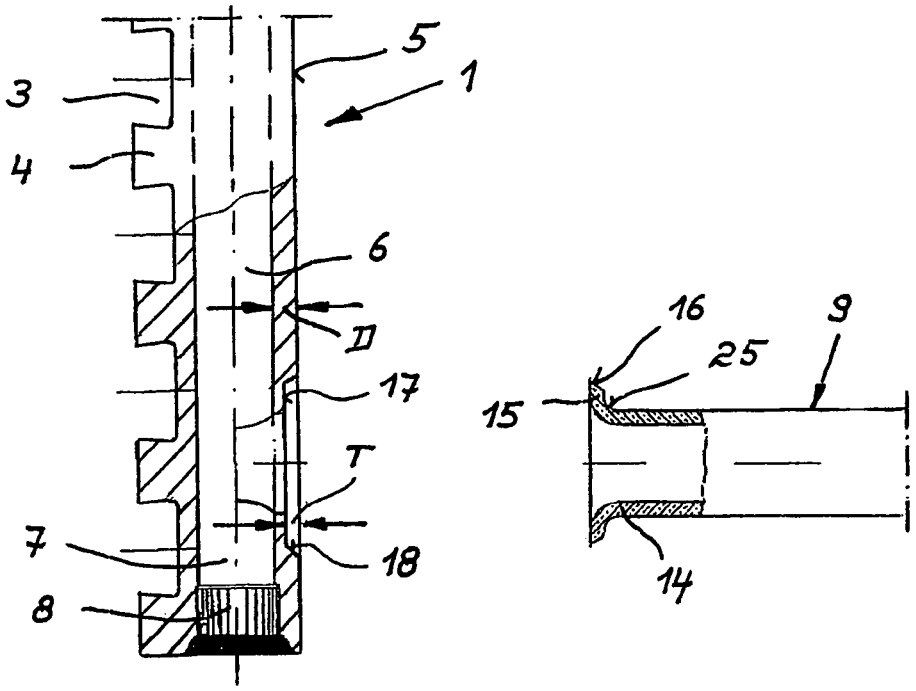
FIG. 5 shows the representation of FIG. 4 before the connection of a connecting pipe to the cooling plate.

As shown in detail in FIGS. 4 and 5, connecting pipes 9 (and correspondingly also connecting pipes 10) are provided at their plate ends 14 with flanges 15, which are formed by being flanged open. Flanges 15 have bevels 16 at their outer circumference. Concave transition regions 25 are shot peened. In the region of a bore hole 6 in cooling plate 1 or in the region of a group of bore holes 6, a recess 17 is worked into the cold side of the plate 5 (FIG. 5). Depth T of recess 17 is less than thickness D of the material between bore hole 6 and the cold side of the plate 5. At the the inner circumference of recess 17, the latter is provided with a bevel 18.

If, according to FIG. 5, a connecting pipe 9 is set into recess 17, a V-shaped free space is formed between outer circumference 16 of flange 15 of connecting pipe 9 and the inner circumference 18 of recess 17, which may be utilized in an ideal way for one's being able now to lay down a V-shaped welding seam 19, according to FIG. 4.

As was indicated above, corresponding to the illustrations of FIGS. 1 through 5, each bore hole 6 may be coupled to a connecting pipe 9, 10 at the upper and lower end. But one might also imagine that two or more bore holes 6 that are smaller in diameter or oval channels might be coupled to a connecting pipe 9, 10.

For the purpose of handling cooling plate 1, an eye is screwed into a tapped hole 20 in upper end face 21.

It may also be seen that, on the cold side of the plate 5, tapped holes 23 are provided, into which fastening screws 24 may be inserted.

What is claimed is:

1. A cooling plate made of copper or a copper alloy for blast furnaces, comprising a plurality of bore holes for accommodating a cooling medium, the bore holes being connected to a cooling medium intake and a cooling medium outlet via connecting pipes that are welded onto a cold side of the plate, wherein the connecting pipes are furnished with flanges at their plate ends, have their flanges set into the recesses of the cold side of the plate, and are welded at an outer circumference of the flanges to the cold side of the plate, wherein the flanges on the connecting pipes are provided with bevels at their outer circumference and the recesses in the cold side of the plate are provided at with bevels at an inner circumference of the recesses.

2. The cooling plate according to claim 1, wherein the flanges on connecting pipes are formed by flanging open the plate ends of the connecting pipes.

3. The cooling plate according to claim 1, wherein the flanges on connecting pipes are formed by flanging open the plate ends of the connecting pipes.

4. The cooling plate according to claim 2, wherein the connecting pipes are blasted in concave transitional regions of the flanges.

5. The cooling plate according to claim 3, wherein the connecting pipes are blasted in concave transitional regions of the flanges.

6. The cooling plate according to claim 1, wherein each bore hole is connected to the cooling medium intake and the cooling medium outlet via the connecting pipes.

7. The cooling plate according to claim 1, wherein each bore hole is connected to the cooling medium intake and the cooling medium outlet via the connecting pipes.

8. The cooling plate according to claim 2, wherein each bore hole is connected to the cooling medium intake and the cooling medium outlet via the connecting pipes.

9. The cooling plate according to claim 1, wherein at least two adjacent bore holes are connected to the cooling medium intake and the cooling medium outlet by one connecting pipe, respectively.

10. The cooling plate according to claim 1, wherein at least two adjacent bore holes are connected to the cooling medium intake and the cooling medium outlet by one connecting pipe, respectively.

11. The cooling plate according to claim 2, wherein at least two adjacent bore holes are connected to the cooling medium intake and the cooling medium outlet by one connecting pipe, respectively.

12. The cooling plate according to claim 1, wherein the plate ends of the connecting pipes are shaped to be oval.

13. The cooling plate according to claim 1, wherein the plate ends of the connecting pipes are shaped to be oval.

14. The cooling plate according to claim 2, wherein the plate ends of the connecting pipes are shaped to be oval.

15. The cooling plate according to claim 1, wherein the connecting pipes, that are made of one of copper and a copper alloy, are furnished with collars of steel, at a distance from the flanges.

16. The cooling plate according to claim 1, wherein the connecting pipes, that are made of one of copper and a copper alloy, are furnished with collars of steel, at a distance from the flanges.

17. The cooling plate according to claim 2, wherein the connecting pipes, that are made of one of copper and a copper alloy, are furnished with collars of steel, at a distance from the flanges.

18. The cooling plate according to claim 1, wherein in the case of the connecting pipes that are made of one of a steel and a steel alloy, one of the bevels on the connecting pipes and the bevels in the recesses are coated with nickel.

19. The cooling plate according to claim 1, wherein the connecting pipes are furnished with flanges that are welded on.

* * * * *